US009315742B2

(12) United States Patent
Aubry et al.

(10) Patent No.: US 9,315,742 B2
(45) Date of Patent: Apr. 19, 2016

(54) PROCESS FOR THE PRODUCTION OF HYDROCARBON FLUIDS HAVING A LOW AROMATIC CONTENT

(75) Inventors: Christine Aubry, Marly le Roi (FR); Joelle Nokerman, Thuin (BE)

(73) Assignee: Total Marketing Services, Puteaux (FR)

( * ) Notice: Subject to any disclaimer, the term of this patent is extended or adjusted under 35 U.S.C. 154(b) by 69 days.

(21) Appl. No.: 13/510,252

(22) PCT Filed: Nov. 19, 2010

(86) PCT No.: PCT/IB2010/055313

§ 371 (c)(1),
(2), (4) Date: May 16, 2012

(87) PCT Pub. No.: WO2011/061716

PCT Pub. Date: May 26, 2011

(65) Prior Publication Data

US 2013/0001127 A1 Jan. 3, 2013

(30) Foreign Application Priority Data

Nov. 20, 2009 (WO) ..... PCT/IB2009/056017

(51) Int. Cl.
*C10G 65/08* (2006.01)
*C10G 45/06* (2006.01)
*C10G 45/44* (2006.01)

(52) U.S. Cl.
CPC ..... *C10G 45/44* (2013.01); *C10G 65/08* (2013.01); *C10G 2300/1051* (2013.01);
(Continued)

(58) Field of Classification Search
CPC ..... C10G 51/00; C10G 53/00; C10G 53/02; C10G 65/00; C10G 65/02; C10G 65/04; C10G 45/44; C10G 65/08; C10G 2300/1051; C10G 2300/1055; C10G 2300/1059; C10G 2300/202
USPC ..... 208/46, 49, 56, 85, 92, 93, 142, 143, 208/144, 177, 209, 212, 216, 216 R
See application file for complete search history.

(56) References Cited

U.S. PATENT DOCUMENTS 3,654,139 A 4/1972 Winsor et al.
3,755,143 A 8/1973 Hosoi et al.
(Continued)

FOREIGN PATENT DOCUMENTS

EA 006835 B1 4/2006
EP 1447437 A1 8/2004
(Continued)

OTHER PUBLICATIONS

Parkash, S, Refining Processes Handbook, 2003, Gulf Publishing, p. 1-49.*
(Continued)

*Primary Examiner* — Renee E Robinson
*Assistant Examiner* — Derek Mueller
(74) *Attorney, Agent, or Firm* — Marsh Fischmann & Breyfogle LLP

(57) ABSTRACT

The invention provides a process to prepare very low sulphur, very low aromatic hydrocarbon fluids having a boiling range in the range of from 100 to 400° C. and a boiling range of not more than 80° C., comprising at least the two successive steps of —deep hydrodesulphurating of middle distillate down to less than 10 ppm sulphur, and —catalytic hydrogenating the desulphurized middle distillates of preceding step at a temperature from 80 to 180° C. and at a pressure from 60 to 160 bars.

43 Claims, 1 Drawing Sheet

(52) U.S. Cl.
CPC ..... *C10G 2300/1055* (2013.01); *C10G 2300/1059* (2013.01); *C10G 2300/202* (2013.01); *C10G 2300/301* (2013.01); *C10G 2300/4006* (2013.01); *C10G 2300/4012* (2013.01); *C10G 2300/4018* (2013.01); *C10G 2300/4081* (2013.01); *C10G 2400/18* (2013.01)

(56) References Cited

U.S. PATENT DOCUMENTS

| | | | | |
|---|---|---|---|---|
| 3,767,562 | A | 10/1973 | Sze et al. | |
| 4,036,734 | A | 7/1977 | Manne et al. | |
| 4,347,124 | A | 8/1982 | Shimoiizaka et al. | |
| 4,447,315 | A | 5/1984 | Lamb et al. | |
| 4,469,590 | A | 9/1984 | Schucker et al. | |
| 4,875,992 | A | 10/1989 | Hamner | |
| 5,114,562 | A | 5/1992 | Haun et al. | |
| 5,498,810 | A | 3/1996 | Bogdan et al. | |
| 5,654,253 | A | 8/1997 | Hucul et al. | |
| 5,954,941 | A | 9/1999 | Mercier et al. | |
| 2006/0161031 | A1* | 7/2006 | Gribschaw et al. | 585/24 |

FOREIGN PATENT DOCUMENTS

| | | | |
|---|---|---|---|
| EP | 1619232 | A1 | 1/2006 |
| GB | 834776 | | 5/1960 |
| GB | 1218920 | | 1/1971 |
| GB | 1282774 | | 7/1972 |
| GB | 1457861 | | 12/1976 |
| GB | 1471228 | | 4/1977 |
| WO | 99/47626 | | 9/1999 |
| WO | 01/83640 | A1 | 11/2001 |
| WO | 0206427 | | 1/2002 |
| WO | 03/074635 | A1 | 9/2003 |
| WO | 03074634 | | 12/2003 |
| WO | 03074635 | | 12/2003 |
| WO | 2006078389 | | 7/2006 |
| WO | 2008/133219 | A2 | 11/2008 |
| WO | 2011/061612 | A2 | 5/2011 |

OTHER PUBLICATIONS

Savva, et al, Benzene hydrogenation over Ni/Al2O3 catalysts prepared by conventional and sol-gel techniques, 2008, Applied Catalysis B: Environment, vol. 79 pp. 199-207.*

* cited by examiner

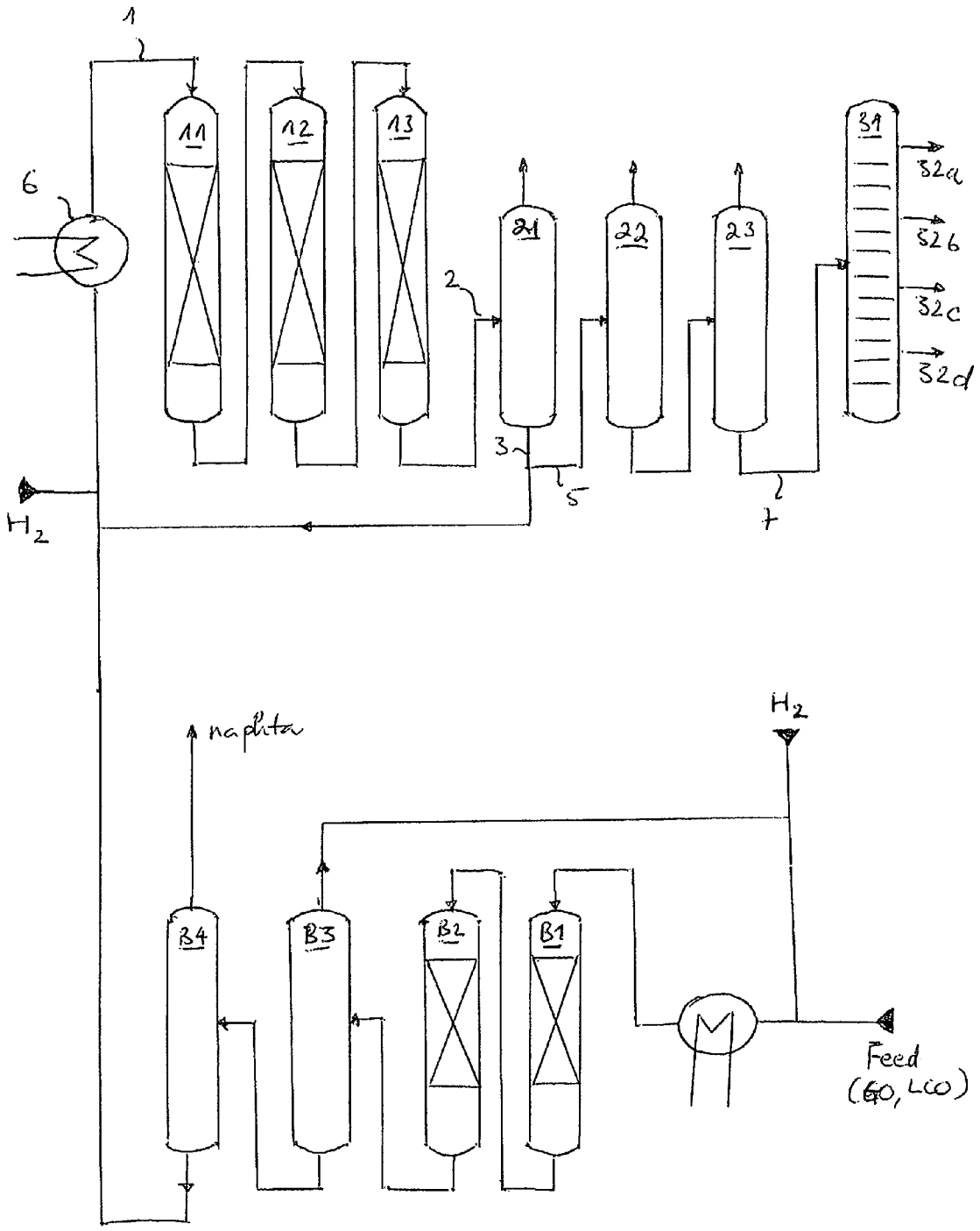
1
6
11
12
13
21
22
23
31
32a
32b
32c
32d
2
3
5
7
H2
naphta
H2
B4
B3
B2
B1
Feed
(GO, LCO)

PROCESS FOR THE PRODUCTION OF HYDROCARBON FLUIDS HAVING A LOW AROMATIC CONTENT

FIELD OF THE INVENTION

The invention relates to the production of specific fluids having a narrow boiling range and having a very low aromatic content, extremely low sulphur level content and their uses. The invention relates to feed quality selection and process conditions.

BACKGROUND ART

Hydrocarbon fluids find widespread use as solvents such as in adhesives, cleaning fluids, explosives solvents for decorative coatings and printing inks, light oils for use in applications such as metalworking or demoulding and industrial lubricants, and drilling fluids. The hydrocarbon fluids can also be used as extender oils in adhesives and sealant systems such as silicone sealants and as viscosity depressants in plasticised polyvinyl chloride formulations and as carrier in polymer formulation used as flocculants for example in water treatment, mining operations or paper manufacturing and also used as thickener for printing pastes. Hydrocarbon fluids may also be used as solvents in a wide variety of other applications such as chemical reactions.

The chemical nature and composition of hydrocarbon fluids varies considerably according to the use to which the fluid is to be put. Important properties of hydrocarbon fluids are the distillation range generally determined by ASTM D-86 or the ASTM D-1160 vacuum distillation technique used for heavier materials, flash point, density, Aniline Point as determined by ASTM D-611, aromatic content, sulphur content, viscosity, colour and refractive index. Fluids can be classified as paraffinic, isoparaffinic, dearomatised, naphthenic, non-dearomatised and aromatic.

These fluids tend to have narrow boiling point ranges as indicated by a narrow range between Initial Boiling Point (IBP) and Final Boiling Point (FBP) according to ASTM D-86. The Initial Boiling Point and the Final Boiling Point will be chosen according to the use to which the fluid is to be put. However, the use of the narrow cuts provides the benefit of a precise flash point which is important for safety reasons. The narrow cut also brings important fluid properties such as a better defined aniline point or solvency power, then viscosity, and defined evaporation conditions for systems where drying is important, and finally better defined surface tension.

WO-A-03/074634 and WO-A-03/074635 are both directed to the production of fluids comprising at least 40% naphthenics and a narrow boiling range. In these two documents, the initial feed is a Vacuum Gas Oil (VGO) that is then subjected to hydrocracking. A typical VGO is disclosed as having the following properties:

Specific Gravity: 0.86-0.94;

ASTM D-1160 distillation: IBP 240-370° C., FBP 380-610° C.

Aromatics wt %: 1 ring from 13 to 27%, 2 rings from 10 to 20%, 3 rings from 7 to 11%, 4 rings from 6 to 12%, total from 40 to 65;

Naphthenes wt %: 1 ring from 2 to 4%, 2 rings from 4 to 7%, 3 rings from 4 to 6%, 4 rings from 4 to 7%, total from 16 to 27;

Paraffins wt %: from 7 to 16%;

IsoParaffins wt %: from 8 to 20%;

Sulphur: from 1.75 to 3 wt % (as measured by ASTM D-2622 using X-Ray Fluorescence);

This VGO is then hydrocracked into a feedstock.

The feedstocks have a low sulphur content, typically 1 to 15 ppm by weight. These feedstocks have also a low aromatic content, typically 3 to 30 wt % (this is said to be lower than the typical range of 15 to 40 wt % in conventional fluid manufacture).

It is indicated that the lower sulphur content can avoid or reduce the need for deep hydrodesulphurisation and also results in less deactivation of the hydrogenation catalyst when hydrogenation is used to produce dearomatised grades. The lower aromatic content also diminishes the hydrogenation severity required when producing dearomatised grades thus allowing the debottlenecking of existing hydrogenation units or allowing lower reactor volumes for new units.

It is further indicated that the resulting products have a high naphthenic content, typically at least 40%, preferably at least 60%.

Hydrogenation of the hydrocracked VGO is said to be operated at a temperature of 200° C., a pressure of 27 bar, a liquid hourly space velocity of 1 $hr^{-1}$, and a treat rate of 200 $Nm^3$/ton of feed.

While these two documents indicate that the final product has a very low content in aromatics, the fact is that high boiling products still contain a rather high amount of aromatics. The product having a boiling range of 237° C. to 287° C. is said to contain 42 ppm of aromatics. The three other products having higher boiling ranges (308° C.-342° C., 305° C.-364° C. and 312° C.-366° C.) have aromatics contents of about 2000 ppm.

EP1447437 discloses a process in which a first stream of hydrocarbons having an aromatics content of at least 70% is subjected to hydrodesulphurization so as to obtain a first stream with a sulphur content of less than 50 ppm, and step of hydrogenation. In this process, the first stream is said to have a distillation interval of 145-260° C., and the example provides for 142-234° C. It is also indicated that the hydrogenated stream can be fractionated, e.g. in light cuts of 100-205° C., middle cuts of 170-270° C. and heavy cuts of 200-400° C. Yet, in the sole example, there is no fractionation taking place. It is suggested in this EP1447437 the desulphuration and hydrogenation of a Light cycle oil fraction from the effluents of an FCC unit. It is however shown that even if the naphthenic content is high (86.5 wt %) which suggests good solvency, the aromatic content remains at 100 ppm.

Thus, the production of fluids from atmospheric distillates cuts after desulphuration to obtain hydrocarbons fluids with very low aromatics content, typically below 100 ppm, is still not taught in the prior art.

The invention thus aims at providing a process for making aliphatic paraffinic and naphthenic fluids having a very low content in aromatics, typically below 100 ppm from desulphurized atmospheric distillate. These fluids present lower density and lower viscosity levels for the same cut ranges, due to lower naphthenic content and higher isoparaffinic content than fluids of the prior art.

SUMMARY OF THE INVENTION

The invention provides a process to prepare very low sulphur, very low aromatic hydrocarbon fluids boiling in the range of from 100 to 400° C. and a having boiling range of not more than 80° C., comprising at least the two successive steps of

- deep hydrodesulphurating of middle distillate down to less than 10 ppm sulphur, and
- catalytic hydrogenating the desulphurized middle distillates of preceding step at a temperature from 80 to 180° C. and at a pressure from 60 to 160 bars.

According to one embodiment, the middle distillates are issued from atmospheric distillation unit and/or catalytic cracking effluents, such distillates having boiling points between 180° C. and 400° C., especially from 200 to 380° C.

According to one embodiment, the middle distillate contains more than 20% aromatics, preferably more than 30%. According to another embodiment, middle distillate contains less than 100% aromatics, preferably less than 70%.

According to one embodiment, the hydrogenated hydrodesulphurized middle distillates (the final product) contain less than 5 ppm sulphur, preferably less than 3 ppm, most preferably 0.5 ppm.

According to one embodiment, the hydrogenated desulphurized fluids contain less than 100 ppm aromatics, preferably less than 50 ppm, and more preferably less than 30 ppm.

According to one embodiment, deep hydrodesulphurization of distillates is operated at a reaction temperature higher than 300° C., preferably varying between 330 and 370° C., under a pressure higher than 80 bars, preferably varying between 80 and 90 bars, in presence of an hydrodesulphurization catalyst with a LHSV varying between 0.5 and 3 $h^{-1}$.

According to one embodiment, the hydrodesulphurization catalyst comprise an alumina support with at least a couple of metals from group VIII, preferably couples of metals such as nickel/molybdenum or cobalt/molybdenum.

A preferred hydrogenation catalyst contains nickel; more preferably the catalyst is a nickel supported catalyst.

According to one embodiment, hydrogenation of desulphurized distillates is performed within three steps including hydrogenation step, then separating step to evaporate remaining gaseous products and a fractionation step.

According to one embodiment, the hydrogenation step includes three hydrogenation stages at liquid hourly space velocity (LHSV) varying from 0.2 to 5 $hr^{-1}$. The treat rate can be from 100 to 300 $Nm^3$/ton of feed. The hydrogenation catalyst can comprise nickel on an alumina carrier, having a specific area varying between 100 and 250 $m^2$/g of catalyst, preferably between 150 and 200 $m^2$/g of catalyst. The amount of catalyst in the three hydrogenation stages is according to the scheme 0.05-0.5/0.10-0.70/0.25-0.85, e.g. 0.07-0.25/0.15-0.35/0.4-0.78 and, most preferably, 0.10-0.20/0.20-0.32/0.48-0.70. The first reactor can be a sulphur trap reactor.

The process may alternatively comprise two hydrogenation steps, wherein the amount of catalyst in the two stages, according to weight amounts of 0.05-0.5/0.5-0.95, preferably 0.07-0.4/0.6-0.93 and most preferably 0.10-0.20/0.80-0.90.

According to one embodiment, the process further comprises a separation stage, whereby unreacted hydrogen is recovered and a stream of hydrogenated desulphurized middle distillate is recovered, and preferably recycled to the inlet of the process. The unreacted hydrogen can be recycled at least in part to the inlet of the process or to the hydrogenation stage. The stream of hydrogenated desulphurized middle distillate can be partly recycled, at least in part, to the inlet or to the hydrogenation stage.

According to one embodiment, the separation stage can comprise at least two, preferably three flash separators staged according to decreasing pressure.

According to one embodiment, the pressure in the last flash separator can be about atmospheric pressure.

According to one embodiment, the process further comprises a step of prefractionation of the low-sulphur feed prior to hydrogenation, into fractions having a boiling range of less than 90° C., preferably 80° C.

According to one embodiment, the process further comprises a step of fractionation of the hydrogenated products into fluids of defined boiling ranges.

According to one embodiment, The prefractionation step can be carried out at a vacuum pressure from 10 to 50 mbars absolute.

The invention also provides the use of the fluids obtained by the process of the invention as drilling fluids, as industrial solvents, in coating fluids, in explosives, in concrete demoulding formulations, in adhesives, in printing inks, in metal working fluids, as cutting fluids, as rolling oils, as EDM fluids, rust preventive in industrial lubricants, as extender oils, in sealants or polymers formulation with silicone, as viscosity depressants in plasticised polyvinyl chloride formulations, in resins, as crop protection fluids, in pharmaceutical products, in polymers used in water treatment, paper manufacturing or printing pastes and cleaning solvents.

DRAWINGS

The attached drawing is a schematic representation of a unit used in the invention.

DESCRIPTION OF EMBODIMENTS OF THE INVENTION

The invention provides specific combination of deep hydrodesulphuration process followed by hydrogenation conditions of low-sulphur, almost sulphur free feeds.

A typical feed will correspond to desulphurized atmospheric distillate comprising typically up to 30 wt % aromatics. Higher aromatics content can be processed, up to 100%. Other feeds can be possibly processed using the present invention such as effluents of FCC units, for example desulphurized light cycle oil (LCO), but preferably in admixture with some atmospheric distillate after desulphuration.

A well known feed is desulphurized atmospheric distillate with a sulphur content decreased down to less than 10 ppm by deep hydrodesulphurating which in the invention is carried out using a hydrodesulphuring unit working under high pressure above 70 bars and high temperature over 300° C., preferably varying between 320 and 370° C. in presence of desulphurisation catalyst in fixed bed reactor. The hydrodesulphurization catalyst comprises an alumina support with at least a couple of metals from group VIII, preferably couples of metals such as nickel/molybdene molybdenum or cobalt/molybdenum, Nickel/molybdenum being preferred. Description of such desulphurization processes and units may be found in "Procédés de transformation" from P leprince chapter 16 from Technip editions ISBN 2-7108-0730-0 (volume 3).

The hydrogenation feed after desulphuration typically contains less than 3 ppm of sulphur, but higher amounts can be processed, for example up to 8 ppm. Lower values are preferred. There is no limit for the lower value; generally the sulphur content is at least 1 ppm. Hence, a typical low-sulphur feed will comprise 0.5 to 1.5 ppm sulphur.

Before entering the hydrogenation unit, a prefractionation can take place. Having a more narrow boiling range entering the unit allows having a more narrow boiling range at the outlet. Typical boiling ranges of prefractionated cuts are 150° C. to 220° C., 220 to 310° C.

The feed is then hydrogenated.

Hydrogen that is used in the hydrogenation unit is typically a high purity hydrogen, e.g. with a purity of more than 99%, albeit other grades can be used.

Hydrogenation takes place is one or more reactor. The reactor can comprise one or more catalytic beds. Catalytic beds are usually fixed beds.

Hydrogenation takes place using a catalyst. Typical hydrogenation catalysts include but are not limited to: nickel, platinum, palladium, rhenium, rhodium, nickel tungstate, nickel molybdenum, molybdenum, cobalt molybdenate, nickel molybdenate on silica and/or alumina carriers or zeolithes. A preferred catalyst is Ni-based on an alumina carrier, having a specific area varying between 100 and 250 $m^2/g$ of catalyst, preferably between 150 and 200 $m^2/g$.

The hydrogenation conditions are typically the following:

60 to 160 bars, preferably 100 to 150 bars, and most preferably 105 to 130 bars

Temperature: 80 to 180° C., preferably 120 to 170° C. and most preferably 130 to 160° C.

Liquid Hourly Space Velocity (LHSV): 0.2 to 5 $hr^{-1}$, preferably 0.5 to 3, and most preferably 0.8 to 1.5

Hydrogen treat rate: 100 to 300 $Nm^3$/ton of feed, preferably 150 to 250 and most preferably 160 to 200.

Using high pressure, low temperature hydrogenation conditions and an effective hydrogenation Ni-containing catalyst, together with high treat rates, in contrast to the prior art, offers several advantages, in peculiar no cracking occurs. Substantially no hydrodesulphurisation takes place: the traces of remaining sulphur compounds are rather trapped into or onto the catalyst rather than being discharged as $H_2S$ in the prior art process. In the conditions, the final product, even with high boiling ranges, typically above 300° C. or even above 320° C., still contains very low aromatics content, typically less than 100 ppm.

The process of the invention can be carried out in several stages. There can be two or three stages, preferably three stages. The first stage will operate the sulphur trapping, hydrogenation of substantially all unsaturated, and up to about 90% of hydrogenation of aromatics. The flow exiting from the first reactor contains substantially no sulphur. In the second stage the hydrogenation of the aromatics continues, and up to 99% of aromatics are hydrogenated. The third stage is a finishing stage, allowing aromatics contents as low as 100 ppm or even less such as below 50 ppm or even below 30 ppm, even for high boiling products.

The catalysts can be present in varying or substantially equal amounts in each reactor, e.g. for three reactors according to weight amounts of 0.05-0.5/0.10-0.70/0.25-0.85, preferably 0.07-0.25/0.15-0.35/0.4-0.78 and most preferably 0.10-0.20/0.20-0.32/0.48-0.70.

It is also possible to have two reactors instead of three.

It is also possible to have two reactors instead of three.

The first stage will operate the sulphur trapping, hydrogenation of substantially all insaturates, and up to about 90% of hydrogenation of aromatics. The flow exiting from the first reactor contains substantially no sulphur. In the second stage the hydrogenation of the aromatics continues, and more than 99% of aromatics are hydrogenated, preferably allowing aromatics contents as low as 100 ppm or even less such as below 50 ppm or even below 30 ppm, even for high boiling products.

The catalysts can be present in varying or substantially equal amounts in each reactor, e.g. for two reactors according to weight amounts of 0.05-0.5/0.5-0.95, preferably 0.07-0.4/0.6-0.93 and most preferably 0.10-0.20/0.80-0.90.

It is also possible that the first reactor be made of twin reactors operated alternatively in a swing mode. This made be useful for catalyst charging and discharging: since the first reactor comprises the catalyst that is poisoned first (substantially all the sulphur is trapped in and/or on the catalyst) it should be changed often.

One reactor can used, in which two, three or more catalytic beds are installed.

It may be necessary to insert quenches on the recycle to cool effluents between the reactors or catalytic beds to control reaction temperatures and consequently hydrothermal equilibrium of the hydrogenation reaction. In a preferred embodiment, there is no necessity for such cooling or quenching.

In case the process makes use of 2 or 3 reactors, the first reactor will act as a sulphur trap, as already indicated especially for benzo and di benzothiophens and their derivatives considered as the most refractory compounds to the deep hydrodesulphurisation. This first reactor will trap substantially all the sulphur. The catalyst will thus be saturated very quickly and may be renewed from time to time; when regeneration or rejuvenation is not possible for such saturated catalyst, the first reactor is considered as a sacrificial reactor which size and catalyst content depends on catalyst renewal frequency.

In an embodiment the resulting product and/or separated gas is/are partly recycled to the inlet of the hydrogenation stages. This dilution helps maintaining the exothermicity of the reaction within controlled limits, especially at the first stage. Recycling also allows heat-exchange before the reaction and also a better control of the temperature.

The stream exiting the hydrogenation unit contains the hydrogenated product and hydrogen. Flash separators are used to separate effluents into gas, mainly remaining hydrogen, and liquids, mainly hydrogenated hydrocarbons.

The process can be carried out using three flash separators, one of high pressure, one of medium pressure, and one of low pressure, very close to atmospheric pressure.

The hydrogen gas that is collected on top of the flash separators can be recycled to the inlet of the hydrogenation unit or at different levels in the hydrogenation units between the reactors.

Because the final separated product is at about atmospheric pressure, it is possible to feed directly the fractionation stage, which is preferably carried out under vacuum pressure that is at about between 10 to 50 mbars, preferably about 30 mbars.

The fractionation stage can be operated such that various hydrocarbon fluids can be withdrawn simultaneously from the fractionation column, and the boiling range of which can be predetermined.

The hydrogenation reactors, the separators and the fractionation unit can thus be connected directly, without having to use intermediate tanks, as is usually the case in the prior art documents. By adapting the feed, especially the initial and final boiling points of the feed, it is possible to produce directly, without intermediate storage tanks, the final products with the desired initial and final boiling points. Moreover, this integration of hydrogenation and fractionation allows an optimized thermal integration with reduced number of equipment and energy savings.

The process of the invention will be disclosed by reference to the enclosed drawing. The complete unit comprises an hydrogenation unit 10, a separation unit 20 and a fractionation unit 30 and a hydrodesulphurisation unit 40.

The hydrodesulphurisation unit 40 operates at a pressure higher than 70 bars, preferably higher than 85 bars. Such units comprise two reactors B1 and B2 working at temperatures between 330 and 360° C., the treat ratio hydrogen to feed at the inlet being for example 100 $Nm^3/m^3$ and LHSV varying from 0.5 to 3 $h^{-1}$. The unit comprises a flash separator B3 and a recycle conduit for recovered separated hydrogen gas. Further, hydrodesulphurised product is stripped in a stripper unit B4, into naphta, and a hydrotreated middle distillate thus recovered is sent to the hydrogenation unit, as reacting feed.

The hydrogenation unit comprises here three reactors 11, 12 and 13, connected in series. The reacting feed enters reactor 11 through line 1, and will pass then the second and eventually third reactor. The reacted stream exists reactor 13 through line 2. It is possible to have part of the reacted product of line 2 recycled to the inlet of the hydrogenation reactors, but one will prefer the mode depicted in the drawing. Line 2 enters high pressure separator 21, and exits through line 3. Line 3 is divided into two lines, 4 and 5.

Line 4 contains the recycled stream. The recycled stream still comprises hydrogen. This is combined with the source of hydrogen and feed, and will eventually flow through line 1. A heat exchanger 6 is used to adjust the temperature of the mixture entering the hydrogenation unit.

The temperature in the reactors is typically about 150-160° C. and the pressure is typically about 140 bars while the hourly space velocity is typically about 0.8 and the treat rate is typically about 100 to 180 $Nm^3$/ton of feed, depending on the feed quality.

The stream exiting the hydrogenation section 10 will enter the first flash separator, the stream out of the first separator is partly recycled and partly sent to the second separator. This recycle ratio is between 2 and 20 typically about 4 to about 5.

The first flash separator is a high pressure separator, operated at a pressure ranging e.g. from about 60 to about 160 bars, preferably from about 100 to about 150 bars, and especially at about 100-120 bars.

The second flash separator 22 is a medium pressure separator, operated at a pressure ranging e.g. from about 10 to about 40 bars, preferably from about 20 to about 30 bars, and especially at about 27 bars.

Then a third, low pressure flash separator 23 is used. This third separator is preferably operated at a pressure ranging e.g. from about 0.5 to 5 bars, preferably from about 0.8 to about 2 bars, and especially at about atmospheric pressure.

A flow of product free of hydrogen is withdrawn through line 7 and sent directly to the fractionation column.

The fractionation column 31 is preferably operated under vacuum pressure, such as about 30 mbars absolute. The temperature profile of the column is set depending of the boiling properties of the products to be recovered.

Different streams 32*a*, 32*b*, 32*c*, 32*d*, can be withdrawn from top to bottom of the column, including at lateral, intermediate levels.

The final products are then sent to storage.

The fluids produced according to the invention possess outstanding properties, aniline point or solvency power, molecular weight, vapour pressure, viscosity, defined evaporation conditions for systems where drying is important, and defined surface tension.

The fluids produced according to the invention also present an enhanced safety, due to the very low aromatics content, less than 100 ppm, typically less than 50 ppm, and preferably less than 30 ppm. This makes them suitable for use as user friendly solvents. Their low density and low viscosity make them more especially suitable for drilling fluids.

The boiling range of the final product is preferably not more than 75° C., preferably not more than 65° C., more preferably not more than 50° C.

The fluids of the present invention also have extremely low sulphur content less than 0.5 ppm, at level too low to be detected by the usual low-sulphur analyzers.

The fluids produced by the present invention have a variety of uses in for example drilling fluids, industrial solvents, in paints composition, in explosives, in printing inks and as metal working fluids, such as cutting fluids EDM (electro discharge machining) fluids, rust preventives, coating fluids and aluminium rolling oils, and in concrete demoulding formulations. They can also be used in industrial lubricants such as shock absorbers, insulation oils, hydraulic oils, gear oils, turbine oils, textile oils and in transmission fluids such as automatic transmission fluids or manual gear box formulations. In all this foreseen uses, the Initial Boiling Point to Final Boiling Point boiling range are selected according to the particular use and composition. The fluids are also useful as components in adhesives, sealants or polymer systems such as silicone sealant, modified silane polymers formulations where they act as extender oils and as viscosity depressants for PVC pastes or Plastisol formulations.

The fluids produced according to the present invention may also be used as new and improved solvents, particularly as solvents for resins. The solvent-resin composition may comprise a resin component dissolved in the fluid, the fluid comprising 5 to 95% by total volume of the composition.

The fluids produced according to the present invention may be used in place of solvents currently used for inks, coatings and the like.

The fluids produced according to the present invention may also be used to dissolve resins such as: a) acrylic-thermoplastic; b) acrylic-thermosetting; c) chlorinated rubber; d) epoxy (either one or two part); e) hydrocarbon (e.g., olefins, terpene resins, rosin esters, petroleum resins, coumarone-indene, styrene-butadiene, styrene, methyl-styrene, vinyl-toluene, polychloroprene, polyamide, polyvinyl chloride and isobutylene); f) phenolic; g) polyester and alkyd; h) polyurethane and modified polyurethane; i) silicone and modified silicone (MS polymers) j) urea; and, k) vinyl polymers and polyvinyl acetate.

Examples of the type of specific applications for which the fluids and fluid-resin blends may be used include coatings, cleaning compositions and inks. For coatings the blend preferably has high resin content, a resin content of 20% to 80% by volume. For inks, the blend preferably contains a lower concentration of the resin, i.e., 5%-30% by volume.

In yet another embodiment, various pigments or additives may be added.

The fluids produced by the present invention can be used as cleaning compositions for the removal of hydrocarbons or in the formulation of coatings or adhesives.

The fluids may also be used in cleaning compositions such as for use in removing ink, more specifically in removing ink from printing machines.

In the offset printing industry it is important that ink can be removed quickly and thoroughly from the printing surface without harming the metal or rubber components of the printing machine. Further there is a tendency to require that the cleaning compositions are environmentally friendly in that they contain no or hardly any aromatic volatile organic compounds and/or halogen containing compounds. A further trend is that the compositions fulfil strict safety regulations. In order to fulfil the safety regulations, it is preferred that the compositions have a flash point of more than 62° C., more preferably a flash point of 90° C. or more. This makes them very safe for transportation, storage and use. The fluids produced according to the present invention have been found to give a good performance in that ink is readily removed while these requirements are met.

The fluids produced according to this invention are also useful as drilling fluids, such as a drilling fluid which has the fluid of this invention as a continuous oil phase. The fluid may also be used as a rate of penetration enhancer comprising a continuous aqueous phase containing the fluid produced according to this invention dispersed therein.

Fluids used for offshore or on-shore applications need to exhibit acceptable biodegradability, human, eco-toxicity, eco-accumulation and lack of visual sheen credentials for them to be considered as candidate fluids for the manufacturer of drilling fluids. In addition, fluids used in drilling uses need to possess acceptable physical attributes. These generally include a viscosity of less than 4.0 cSt at 40° C., a flash value of less than 100° C. and, for cold weather applications, a pour point of −40° C. or lower. These properties have typically been only attainable through the use of expensive synthetic fluids such as hydrogenated polyalphaolefins, as well as unsaturated internal olefins and linear alpha-olefins and esters. The properties can however be obtained in some fluids produced according to the present invention Drilling fluids may be classified as either water-based or oil-based, depending upon whether the continuous phase of the fluid is mainly oil or mainly water. Water-based fluids may however contain oil and oil-based fluids may contain water and the fluids produced according to this invention are particularly useful as the oil phase.

Typically preferred ASTM D-86 boiling ranges for the uses of the fluids are that printing ink solvents (sometimes known as distillates) have boiling ranges in the ranges 235° C. to 265° C., 260° C. to 290° C. and 280° C. to 315°. Fluids preferred for use as drilling fluids have boiling ranges in the ranges 195° C. to 240° C., 235° C. to 265° C. and 260° C. to 290° C. Fluids preferred for explosives, concrete demoulding, industrial lubricants, transmission fluids and metal working fluids having boiling ranges in the ranges 185° C. to 215° C., 195° C. to 240° C., 235° C. to 365° C., 260° C. to 290° C., and 280° C. to 325° C. Fluids preferred as extenders for sealants having boiling ranges in the ranges 195° C. to 240° C., 235° C. to 265° C., 260° C. to 290° C., 280° C. to 325° C. Fluids preferred as viscosity depressants for polyvinyl chloride plastisols have boiling ranges in the ranges 185° C. to 215° C., 195° C. to 240° C., 235° C. to 265° C., 260° C. to 290° C., 280° C. to 315° C.

Fluids preferred as carrier for polymeric composition used in water treatment, mining operation or printing pastes have boiling ranges in the ranges 185° C. to 215° C., 195° C. to 240° C., 235° C. to 265° C., 260° C. to 290° C., 280° C. to 315° C.

For Pharmacological application, fluids have boiling ranges in intervals between 275° C. to 330° C.

For paint compositions and cleaning applications, the most preferred boiling range are in intervals 140 to 210° C., and 180 to 220° C. Fluids showing an initial boiling point above 250° C. and a final boiling point close to 330° C. or preferably close to 290° C. will be preferred for low VOC coatings formulations.

EXAMPLES

The following examples illustrate the invention without limiting it.

Example 1

The aim of the present example is to describe the preparation of hydrocarbon fluids according to the present invention and comparison with hydrocarbon fluids prepared according to the prior art such as those obtained by hydrogenation of hydrocracked vacuum distillate such as disclosed on patents WO3/074634 and WO03/074635. The dearomatised desulphurised distillate prepared according to these patents is fractionated into cuts Ti of intervals of temperature of 65° C. The characteristics of these cuts are given in table 1 hereafter.

In the present invention, some light distillate from atmospheric distillation having boiling range of 180° C. to 300° C. has been desulphurized on a nickel/molybdenum on alumina support catalyst under 88 bars at temperature varying from 330° C. to 360° C. at a LHSV of 2 $h^{-1}$ with the above treat rate to obtain an intermediate product with following characteristics:

sulphur content: 0.5 ppm,
aromatic content: 21.9% wt
Density: 0.830.

The desulphurized light distillate has been further hydrogenated to be dearomatised in presence of a nickel hydrogenating catalyst according to the invention under pressure of 105 bars, at a liquid hourly space velocity (LHSV) of 1 $h^{-1}$ and at temperature between 155 and 160° C. Then the resulting hydrogenating desulphurized distillate is fractionated in cuts Di having temperature range of less than 65° C. Characteristics of these cuts are given in table 1 hereafter.

TABLE 1

| Characteristics | units | Methods | T1 | T2 | D1 | D2 | D3 |
|---|---|---|---|---|---|---|---|
| Density at 15° C. | kq/m3 | ASTM D4052 | 842 | 847 | 823 | 823 | 822 |
| Saybolt colour | | ASTM D56 | | 30 | 30 | >+30 | >+30 |
| sulphur ppm | ppm | ASTM D5453 | | | <1 | <1 | <1 |
| distillation IBP | ° C. | ASTM D86 | 237 | 305 | 231 | 243 | 278 |
| Distillation FBP | ° C. | ASTM D86 | 287 | 364 | 266 | 286 | 309 |
| Flash pt | ° C. | ASTM D93 | 100 | 154 | 100 | 109 | 138 |
| Aniline pt | ° C. | ASTM D611 | 76 | 89 | 79 | 84 | 89 |
| viscosity at 40° C. | $mm^2/s$ | ASTM 445 | 3.0 | 5.2 | 2.4 | 3.0 | 4.0 |
| pour pt ° C. | ° C. | ASTM D97 | −40 | −12 | −33 | −21 | −12 |
| aromatics | ppm | UV method | 42 | 1840 | 12 | 24 | 48 |
| napthenes | % wt | GC | 78.9 | 71.7 | 55.8 | 52.1 | 44.3 |
| mononaphtenes | % wt | GC | 25.3 | 22.9 | 20.8 | 20.3 | 18.4 |
| polynapthenes | % wt | GC | 53.6 | 48.8 | 35.0 | 31.8 | 25.8 |
| paraffines | % wt | GC | 21.1 | 28.3 | 44.2 | 47.9 | 55.7 |
| iso-paraffines | % wt | GC | 15.1 | 20.9 | 30.2 | 32.0 | 38.2 |
| n-paraffines | % wt | GC | 6.0 | 7.4 | 13.9 | 15.9 | 17.5 |

The comparison between products from the prior art with those of the present invention shows that:

- the products according to the invention are free of sulphur and present very low aromatic content
- the aromatic content of the products according to the invention is much lower than those of the prior art (less than 100 ppm instead of about 2000 ppm for the highest boiling ranges)
- viscosity and density are much lower that make them very suitable for drilling fluids.

In addition, the composition in terms of isoparaffins and naphthens are different.

Example 2

The aim of the present example is to describe the preparation of hydrocarbon fluids according to the present invention using two or three stages of hydrogenation.

Operative conditions for hydrogenation step is made within two or three stages are given in the following Table 2. The same feed has been treated according to the two possible process: it is a deep desulphurized distillate (obtained by deep hydrodesulphurating an original feed containing 75% of atmospheric distillate and 25% of Light cycle oil or LCO) having less than 3 ppm sulphur content and 25% total aromatics content, and a distillation range between 220 and 350° C.

The table 2 also reports a ratio between the two embodiment, where the ratio represents the technical gain ratio, taking into account the catalyst replacement requirement and the numbers of hydrogenation unit shut down on a given period (in the example: five operating years). The ratio is expressed in % and is the sum of the % dedicated to the catalyst (where a high % is less valuable than a low %) and the % dedicated to the unit stops (again, where a high % is less valuable than a low %). The catalyst % expresses the replacement need (and indirectly the cost) and the unit stop % expresses the number of stops needed (and hence also indirectly the cost).

TABLE 2

| | % catalyst | Temperature ° C. | | pressure | Technical ratio Three stages/two stages | | |
|---|---|---|---|---|---|---|---|
| | Wt ratio | In | Out | Bars abs | Catalyst/ year | unit stop | Total |
| Two stages | | | | | | | |
| 1st reactor | 0.1 | 130 | 160 | 110 | 41% | 53% | 94% |
| 2nd reactor | 0.9 | 157 | 161 | 105 | 3% | 5% | 6% |
| Three stages | | | | | | | |
| 1st reactor | 0.15 | 130 | 155 | 106 | 38% | 35% | 73% |
| 2nd reactor | 0.3 | 155 | 158 | 105 | 3% | 3% | 6% |
| 3rd reactor | 0.55 | 158 | 156.5 | 103 | 0.5% | 0.5% | 1% |

According to the preceding table, it is clear that we may reduce the technical ratio by 20%. A similar economic gain is also achieved. by using three reactors instead of two, due to a reduction of catalyst replacement cost and reduced numbers of hydrogenation unit shut down on a given period (in the example: five operating years). Hence, the three stages process offers an advantage over the two stages process.

The invention claimed is:

1. Process to prepare very low sulphur, very low aromatic hydrocarbon fluids containing less than 5 ppm sulphur and having a content in aromatics below 100 ppm, boiling in the range of from 100 to 400° C. and having a boiling range of not more than 80° C., comprising at least the two successive steps of deep hydrodesulphurating of middle distillate down to less than 10 ppm sulphur, wherein the deep hydrodesulphurization of middle distillate is operated at a reaction temperature higher than 320° C. under a pressure higher than 70 bars and catalytic hydrogenating the desulphurized middle distillates of the preceding step at a temperature from 80 to 180° C. and at a pressure from 60 to 160 bars, with a supported nickel-containing catalyst, a hydrogen treat rate ranging from 100 to 300 $Nm^3$/ton of feed, the catalytic hydrogenation being performed in at least two stages, wherein the first stage operates sulphur trapping on the supported nickel-containing catalyst, hydrogenation of substantially all unsaturated hydrocarbons and up to 90% hydrogenation of aromatics, wherein the middle distillate is issued from atmospheric distillation unit effluents or from atmospheric distillation unit and catalytic cracking effluents, such distillates boiling in the range of from 200° C. to 380° C.

2. Process of claim 1 wherein the middle distillate contains more than 20% aromatics.

3. Process of claim 1 wherein the middle distillate contains less than 100% aromatics.

4. Process of claim 1 wherein the hydrogenated hydrodesulphurized fluids contain less than 3 ppm sulphur.

5. Process of claim 1, wherein the hydrogenated desulphurized fluids contain less than 50 ppm aromatics.

6. Process of claim 1, wherein deep hydrodesulphurization of distillates is operated at a reaction temperature varying between 330 and 370° C., under a pressure higher than 80 bars, in the presence of a hydrodesulphurization catalyst with a liquid hourly space velocity (LHSV) varying between 0.5 and 3 $h^{-1}$.

7. Process of claim 1, wherein the hydrodesulphurization catalyst comprises an alumina support with at least a couple of metals from Group VIII.

8. Process of claim 1, wherein in the hydrogenation step, the liquid hourly space velocity (LSHV) is from 0.2 to 5 $hr^{-1}$.

9. Process of claim 1, wherein in the hydrogenation step, the catalyst comprising nickel is a supported catalyst on an alumina carrier having a specific surface area varying between 100 and 250 $m^2$/g of catalyst.

10. Process of claim 1, wherein in the hydrogenation step, the temperature is 120 to 160° C.

11. Process of claim 1, wherein in the hydrogenation step, the pressure is from 100 to 150 bars.

12. Process of claim 1, wherein in the hydrogenation step, the temperature is from 80 to 160° C. and the pressure is from 100 to 160 bars.

13. Process of claim 1 wherein the hydrogenation of desulphurized distillates is performed within three hydrogenation stages, followed by a separating step to evaporate remaining gaseous products and a fractionation step.

14. Process of claim 13, wherein the weight amount (wt. %) of catalyst in the three hydrogenation stages is 5-50 wt. %, 10-70 wt. % and 25-85 wt. %, respectively.

15. Process of claim 14, wherein the weight amount (wt. %) of catalyst in the three hydrogenation stages is 7-25 wt. %, 15-35 wt. % and 40-78 wt. %, respectively.

16. Process of claim 1, wherein the hydrogenation of desulphurized distillates is performed within two hydrogenation stages, followed by a separating step to evaporate remaining gaseous products and a fractionation step.

17. Process of claim 16, wherein the amount of catalyst in the two stages, according to weight amounts (wt. %) is 5-50 wt. % and 50-95 wt. %, respectively.

18. Process of claim 17, wherein the amount of catalyst in the two stages according to weight amounts (wt. %) is 7-40 wt. % and 60-93 wt. %, respectively.

19. Process of claim 1, wherein the hydrodesulphurized middle distillate contains less than 8 ppm sulphur.

20. Process of claim 1, further comprising a separation stage, whereby unreacted hydrogen is recovered and a stream of hydrogenated desulphurized middle distillate is recovered.

21. Process of claim 20, wherein the unreacted hydrogen is recycled at least in part to the inlet of the process or to the hydrogenation stage.

22. Process of claim 1, wherein a stream of hydrogenated desulphurized middle distillate is partly recycled, at least in part, to the inlet or to the hydrogenation stage.

23. Process of claim 20, wherein the separation stage comprises at least two flash separators staged according to decreasing pressure.

24. Process of claim 23, wherein the pressure in the last flash separator is about atmospheric pressure.

25. Process of claim 1, further comprising a step of prefractionation of the desulphurized middle distillates prior to hydrogenation, into low-sulphur feed fractions having a boiling range of less than 90° C. then subjected to hydrogenation.

26. Process of claim 1, further comprising a step of fractionation of the hydrogenated products into fluids of defined boiling ranges.

27. Process of claim 25, wherein the prefractionation step is carried out at a vacuum pressure from 10 to 50 mbars absolute.

28. Process of claim 15, wherein the weight amount (wt. %) of catalyst in the three hydrogenation stages is 10-20 wt. %, 20-32 wt. % and 48-70 wt. %, respectively.

29. Process of claim 2, wherein the middle distillate contains more than 30% aromatics.

30. Process of claim 3, wherein the middle distillate contains less than 70% aromatics.

31. Process of claim 4, wherein the hydrogenated hydrodesulphurized fluids contain less than 0.5 ppm sulphur.

32. Process of claim 5, wherein the hydrogenated desulphurized fluids contain less than 30 ppm aromatics.

33. Process of claim 6, wherein deep hydrodesulphurization of distillates is operated under a pressure varying between 80 and 90 bars.

34. Process of claim 7, wherein the couple of metals from group VIII are nickel/molybdenum.

35. Process of claim 8, wherein in the hydrogenation step, the liquid hourly space velocity (LSHV) is from 0.5 to 3 $hr^{-1}$.

36. Process of claim 8, wherein in the hydrogenation step, the liquid hourly space velocity (LSHV) is from 0.8 to 1.5 $hr^{-1}$.

37. Process of claim 1, wherein in the hydrogenation step, the treat rate is from 150 to 250 $Nm^3$/ton of feed.

38. Process of claim 1, wherein in the hydrogenation step, the treat rate is from 160 to 200 $Nm^3$/ton of feed.

39. Process of claim 9, wherein in the hydrogenation step, the catalyst has a specific surface area varying between 150 and 200 $m^2$/g of catalyst.

40. Process of claim 12, wherein in the hydrogenation step, the treat rate is above 150 $Nm^3$/ton of feed.

41. Process of claim 18, wherein the amount of catalyst in the two stages according to weight amounts (wt. %) is 10-20 wt. % and 80-90 wt. %, respectively.

42. Process of claim 19, wherein the hydrodesulphurized middle distillate contains less than 5 ppm sulphur.

43. Process of claim 1, further comprising a step of prefractionation of the desulphurized middle distillates prior to hydrogenation, into low-sulphur feed fractions having a boiling range of less than 80° C., then subjected to hydrogenation.

* * * * *